US005860268A

United States Patent [19]

McWilliams

[11] Patent Number: 5,860,268

[45] Date of Patent: Jan. 19, 1999

[54] LIGHT-WEIGHT CONCRETE DOOR

[76] Inventor: William McWilliams, 4701 East Indian Bend, Paradise Valley, Ariz. 85253

[21] Appl. No.: 811,319

[22] Filed: Mar. 4, 1997

[51] Int. Cl.[6] ..... E04B 1/00

[52] U.S. Cl. ..... 52/784.11; 52/601; 52/656.3; 52/232; 109/83; 49/503

[58] Field of Search ..... 52/784.4, 784.12, 52/784.13, 782.1, 600, 601, 656.4, 656.3, 204.1, 232; 109/76, 80, 82, 83, 85; 49/503, 505

[56] References Cited

U.S. PATENT DOCUMENTS

| | | | |
|---|---|---|---|
| 3,760,540 | 9/1973 | Latoria et al. | 52/601 X |
| 4,218,848 | 8/1980 | Nelson | 49/503 |
| 4,343,127 | 8/1982 | Greve et al. | 52/232 X |
| 4,372,092 | 2/1983 | Lopez | 52/612 |
| 4,561,212 | 12/1985 | Ullman, Jr. | 49/503 |
| 4,748,771 | 6/1988 | Lehnert et al. | 52/784.11 X |
| 5,050,507 | 9/1991 | Shoyat | 109/83 |
| 5,055,252 | 10/1991 | Zimmerman | 52/742.14 X |
| 5,065,558 | 11/1991 | Boatsman | 52/601 X |
| 5,181,961 | 1/1993 | Umaki et al. | 106/724 |
| 5,483,771 | 1/1996 | Herbst | 52/204.1 X |

*Primary Examiner*—Carl D. Friedman
*Assistant Examiner*—Winnie S. Yip
*Attorney, Agent, or Firm*—Meschkow & Gresham, P.L.C.; Jordan M. Meschkow; Lowell W. Gresham

[57] ABSTRACT

A three-hour fireproof door (20) is made from a metal frame (26), a body (28), and a hinge (30). The body (28) is made from a concrete mix (40). The metal frame (26) is such that, when attached to a mold base (34), the body (28) may be cast in place. The concrete mix (40) contains an integral strengthening material (54) in the form of either a metal mesh (54) or an elastomer admixture (82).

20 Claims, 8 Drawing Sheets

LIGHT-WEIGHT CONCRETE DOOR

TECHNICAL FIELD OF THE INVENTION

The present invention pertains to special purpose doors. More specifically, the present invention pertains to the construction of concrete fire and security doors of a size and thickness suitable for conventional public-building doorframes.

BACKGROUND OF THE INVENTION

Fire doors are rated in terms of the length of time a door can be exposed to furnace temperatures on one side of the door (the exposed side) without either excessive deformation of the door or excessive temperature rise on the opposite side of the door (the protected side). Additionally, the door under test is subjected to a water stream upon its exposed side immediately after the furnace temperatures are removed. These tests become increasingly rigorous as door ratings increase, i.e., the furnace temperatures become higher and the volume and force of the water stream increases for higher ratings.

Those skilled in the art recognize the fire resistance of concrete. Indeed, fireproof structures often use concrete as a basic construction material. For example, a conventional fireproof room may have concrete walls and a metal fire door, or a conventional fireproof wall may be constructed of a plurality of insulating concrete panels.

Concrete is a poor conductor of heat. Exposure of one surface of a concrete wall to a high temperature relative to the opposite surface produces a large thermal gradient through the wall. Such a thermal gradient may cause the wall to crack and, ultimately, to crumble due to uneven thermal expansion within the concrete. This effect increases as the thickness of the concrete decreases. The addition of rebar or other metal reinforcements to the wall may actually accelerate failure due to the widely differing thermal expansion coefficients of concrete and steel.

As a result of the tendency of concrete to crack when unevenly heated, fireproof doors of sizes and thicknesses for use in conventional public-building doorways tend not to be made from concrete. The ASTM (American Society for Testing and Materials) standard E152-72 for fire door testing has proven to be too rigorous for use with conventional concrete fireproof door construction techniques. Because of the severe thermal stresses induced in a door subjected to the ASTM standard, the test also determines suitability of a door for use as a security door, i.e., how well a door can resist impact damage and cracking.

For use as fire doors and security doors, the mechanical strength and weight are defining factors. Unfortunately, the stronger concrete is made, the denser it becomes and the more likely it is to crack under ASTM testing. Also, a stronger, denser concrete is likely to be too heavy for many door applications, e.g., in public buildings such as motels.

Those skilled in the art know that the addition of pumice may make concrete lighter without significantly affecting its strength. However, only insignificant reduction in weight results from the use of small-diameter aggregates, while large-diameter aggregates are unsuitable for the relatively thin panels used in doors as the aggregate diameter approaches a large percentage of door thickness.

Were a suitable concrete available, one that is both light-weight and capable of passing ASTM testing, its strength and dimensional stability would make it a desirable material for fireproof and security doors intended for public building use.

SUMMARY OF THE INVENTION

Accordingly, it is an advantage of the present invention to provide a lightweight, reinforced concrete door capable of passing ASTM standard testing for a "three-hour" door.

Similarly, another advantage of the present invention is to provide a specific concrete mix for such a door.

Another advantage of the present invention is to provide a concrete and steel fire and/or security door suitable for use in public and commercial buildings, having a height of approximately 7 feet, a width of approximately 3 feet, and a thickness of approximately 1¾ inches, containing slightly more than 3 cubic feet (0.11 cubic yards) of concrete, and weighing less than two hundred pounds.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
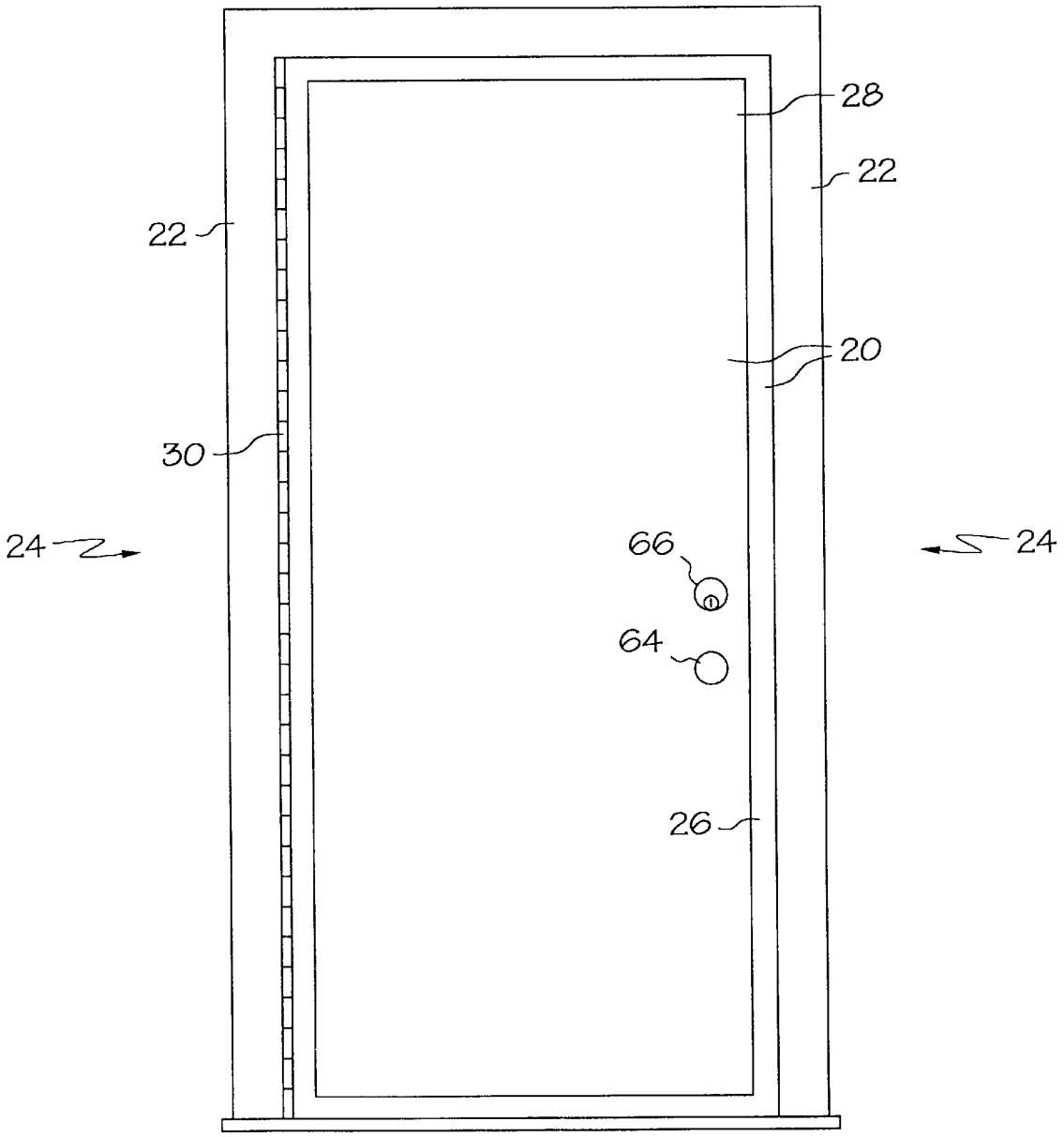
FIG. 1 is a planar view of a light-weight concrete door mounted in a doorframe in a building wall according to a preferred embodiment of the present invention.

FIG. 1 is a planar view of a light-weight concrete door 20 mounted in a doorframe 22 in a building wall 24 according to a preferred embodiment of the present invention. Door 20 contains a metal frame 26, a body 28, and a hinge 30. Door 20 is attached to doorframe 22 by hinge 30. Properly finished, door 20 provides a pleasing appearance while simultaneously providing high security and a three-hour fire barrier.

Figure 2:
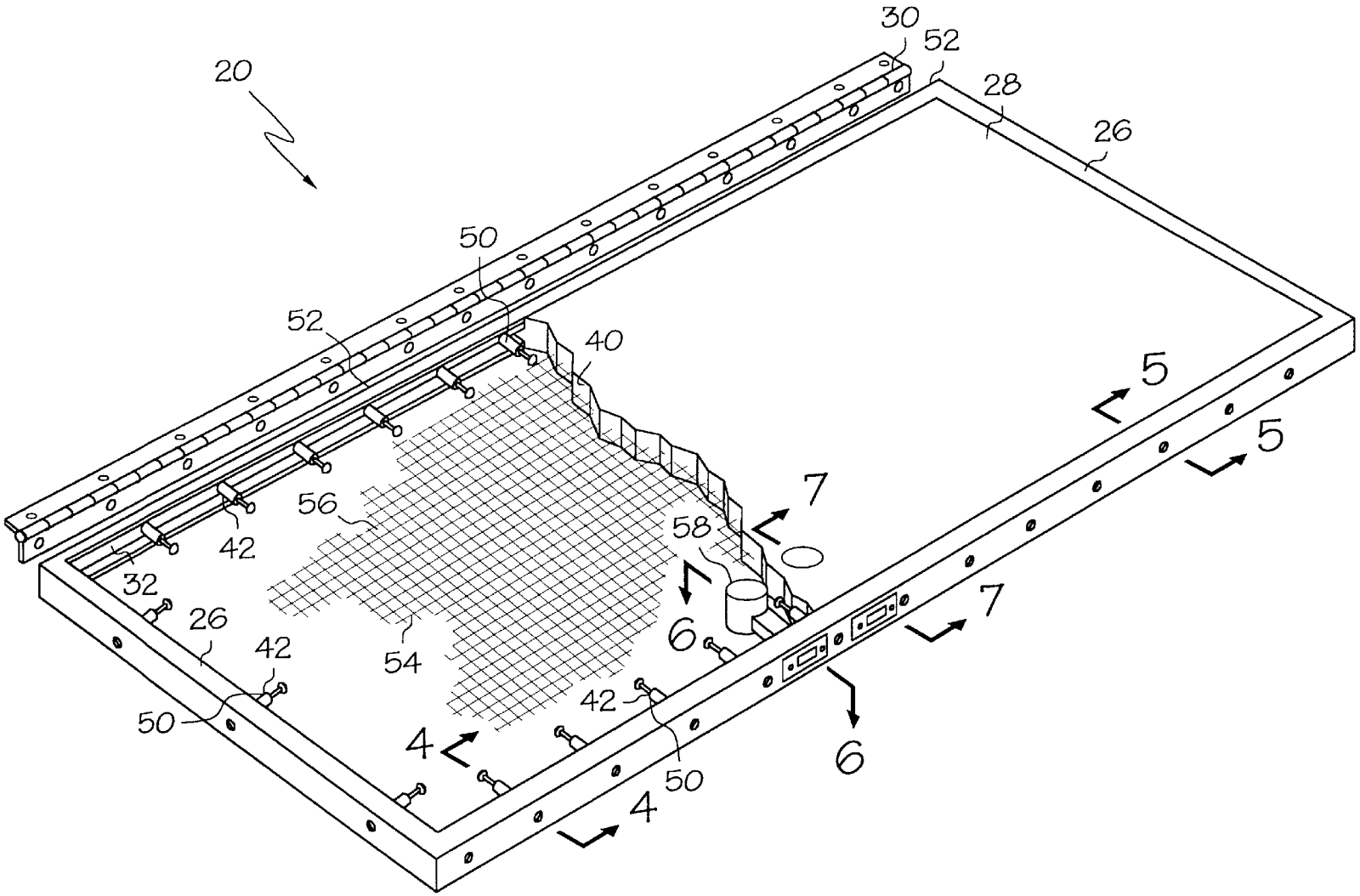
FIG. 2 is a cut-away isometric view of a light-weight concrete door according to a preferred embodiment of the present invention.

FIG. 2 is a cut-away isometric view of door 20 according to a preferred embodiment of the present invention. Metal frame 26 is a U-channel 32 formed into a rectangle with the open side of the "U" pointing inward. Once so formed, U-channel 32 becomes the outside edge of door 20, defining its shape and size. In the preferred embodiment, metal frame 26, hence door 20, is approximately 3 feet in width, approximately 7 feet in height, and less than 2 inches (approximately 1¾ inches) in thickness, making it suitable for use as a fire or security door in public and commercial buildings, e.g., hotels and motels, offices, retail establishments, etc.

Figure 3:
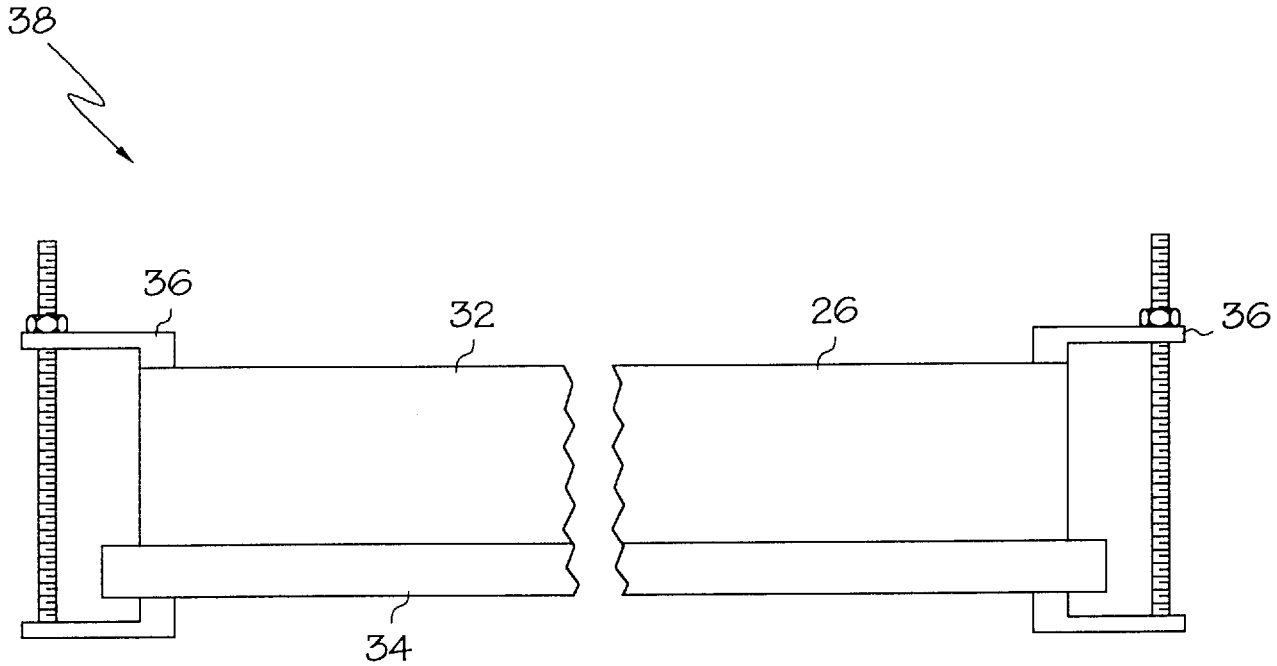
FIG. 3 is an end view depicting a door metal frame temporarily clamped to a mold base according to a preferred embodiment of the present invention.

FIG. 3 is an end view depicting metal frame 26 temporarily clamped to a mold base 34 according to a preferred embodiment of the present invention. Mold base 34 is normally the top of a vibrating table. Metal frame 26 is temporarily coupled to mold base 34 by a plurality of clamps 36 in order to form a mold 38. Those skilled in the art will acknowledge that mold base 34 may be attached to metal frame 26 in a myriad of ways.

Referring to FIGS. 2 and 3, mold 38 is used to cast body 28 within mold 38, constructed of metal frame 26 and mold base 36, to fabricate door 20. Body 28 is formed of a concrete mix 40. Concrete mix 40 is made up of a number of components (discussed later) mixed into a slurry. Concrete mix 40 is poured into mold 38 to cast body 28 of door 20 in place within metal frame 26. The vibrational aspects of mold 38 are desirable during pouring to assist in forming concrete mix 40 around all parts and into all corners of metal frame 26. Once concrete mix 40 has cured, body 28 and metal frame 26 are detached from mold base 34, extracting door 20, and door 20 is complete.

Figure 4:
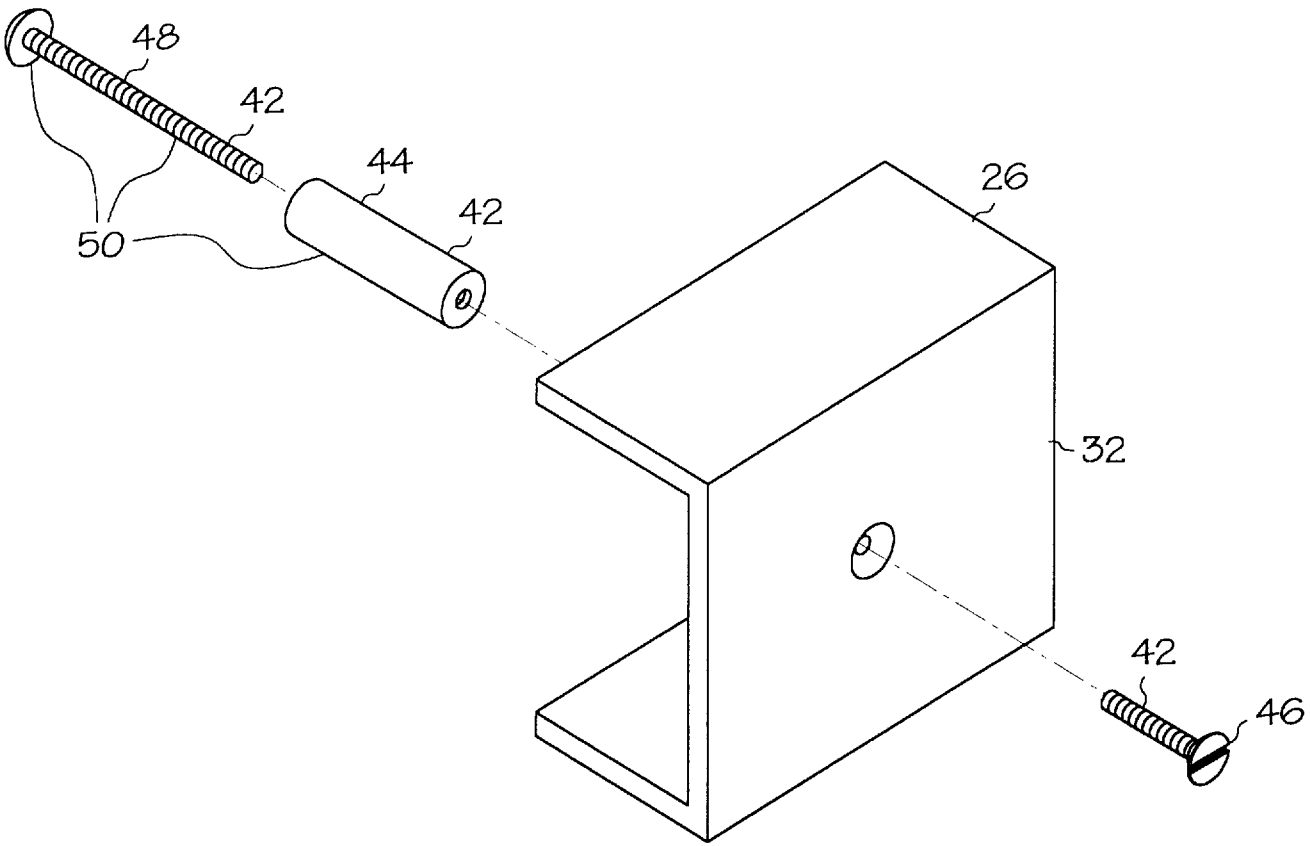
FIG. 4 is an exploded isometric view depicting the attachment of a bonding device to a metal frame, taken along line 4—4 of FIG. 2.
Figure 5:
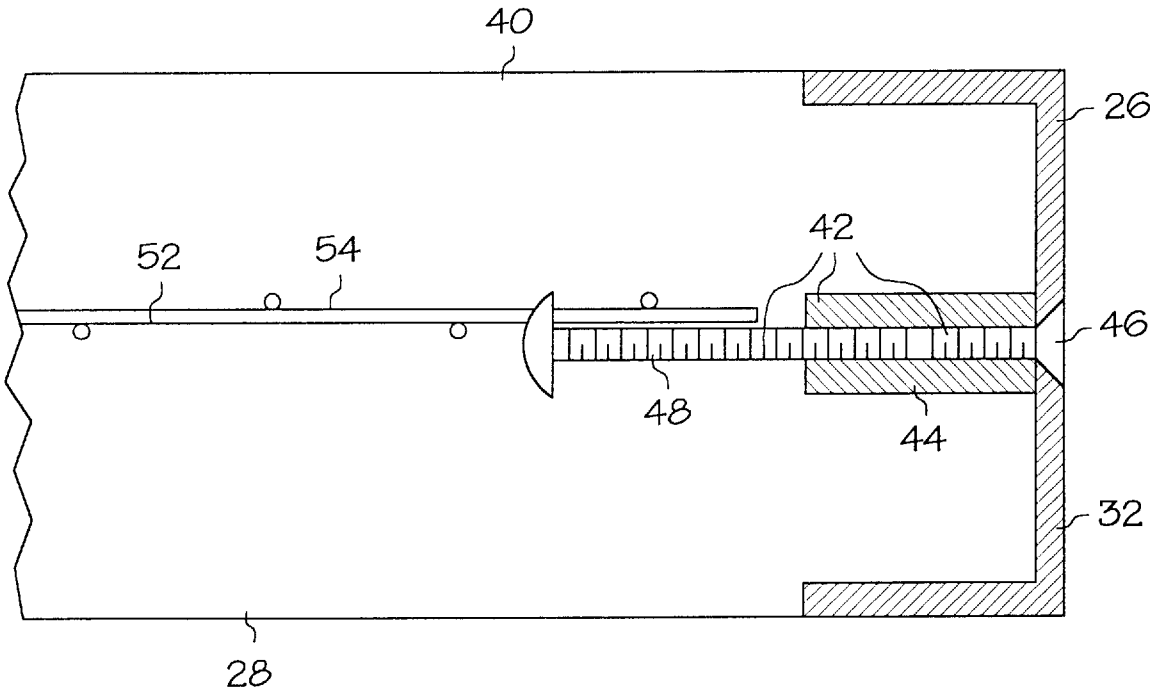
FIG. 5 is a cross-sectional view of an edge of a light-weight concrete door depicting a bonding device, taken along line 5—5 of FIG. 2.

FIG. 4 is an exploded isometric view depicting the attachment of a bonding device 42 to metal frame 26, taken along line 4—4 of FIG. 2, while FIG. 5 is a cross-sectional view of an edge of door 20 depicting bonding device 42, taken along line 5—5 of FIG. 2. The following discussion refers to FIGS. 2, 4, and 5.

In order to form a strong bond between metal frame 26 and body 28, U-channel 32 has around its inside periphery a plurality of bonding devices 42. In the preferred embodiment, each bonding device 42 is formed of a threaded cylinder or standoff 44 fastened to the inside of U-channel 32 by a flat-head screw 46, with a round- or pan-head screw 48 threaded partway into the opposite end of threaded cylinder 44. Threaded cylinder 44 together with the head and shank of round-head screw 48 form an irregularly-shaped member 50 around which concrete mix 40 forms to develop a firm bond with metal frame 26.

Essentially, irregularly-shaped member 50 should have a first part that extends into concrete mix 40 in a first direction approximately perpendicular to the adjacent edge of door 20, then protrude into concrete mix 40 in a second direction approximately perpendicular to the first direction. The assembly of screw 48 and cylinder 44 satisfies this requirement, the shaft of screw 48 and cylinder 44 make up the first direction and the head of screw 48 makes up the second direction.

Those skilled in the art will realize that there are a multitude of methods of forming and attaching irregularly-shaped member 50, e.g., a "bent nail" type of device, a bent tab formed from U-channel 32, an extruded form, etc.

One advantage of forming members 50 from screws 48 and cylinders 44 is that, by using an appropriate number of members 50 in appropriate positions along a hinge edge 52 of door 20, hinge 30 may be attached to door 20 using the same screws 46 used to attach members 50 to U-channel 32. Other methods of attaching hinge 30 may, of course, be used.

In the preferred embodiment, hinge 30 is a piano hinge. That is, hinge 30 is a single hinge substantially equal in length to door 20 and is attached both to door 20 and doorframe 22 throughout its length. Hinge 30, by its shape and mounting, serves as extra reinforcement of hinge edge 52 of door 20. Also, hinge 30, by being a full-length hinge, allows the weight of door 20 to be distributed over a large portion of doorframe 22. Both these characteristics serve to inhibit warping of door 20 during a fire, thus serving to add to the fireproof characteristics of door 20 as well as inhibiting the jamming of door 20 into doorframe 22.

A strengthening material 54 is added to concrete mix 40 during mixing. In the preferred embodiment, strengthening material 54 is a non-metallic fibrous material, such as a long-fiber elastomer, which permeates concrete mix 40 and inhibits crumbling and cracking of body 28 during a fire.

In an alternative embodiment, however, strengthening material 54 is provided in the form of a metal mesh 56 added to metal frame 26 to embed within body 28 (see FIG. 2). Metal mesh 56 is typically made of 18–14 gauge steel wire in a ¾–1¼ mesh (ideally 16 gauge steel wire in a 1" mesh). If the wire is of too small a gauge, metal mesh 56 may not have sufficient strength. If the wire is of too great a gauge, metal mesh 56 may have too high a thermal expansion coefficient and may sever its bond with body 28 during a fire. Similarly, if the mesh is too fine, the flow of concrete mix 40 during casting may be inhibited and voids may develop. If the mesh is too coarse, metal mesh 56 may not have sufficient strength.

Ideally, metal mesh 56 would be positioned within metal frame 26 approximately midway between the faces of door 20, prior to casting. This may be accomplished by tying or otherwise fastening metal mesh 56 to some of bonding devices 42 as required to retain metal mesh 56 in position. Once metal mesh 56 is in position, concrete mix 40 is cast and door 20 formed.

Those skilled in the art will readily appreciate that there are numerous ways of positioning metal mesh 56 within body 28, other gauges and/or non-metallic meshes of other materials, as long as finished door 20 can pass appropriate testing for the use intended.

Figure 6:
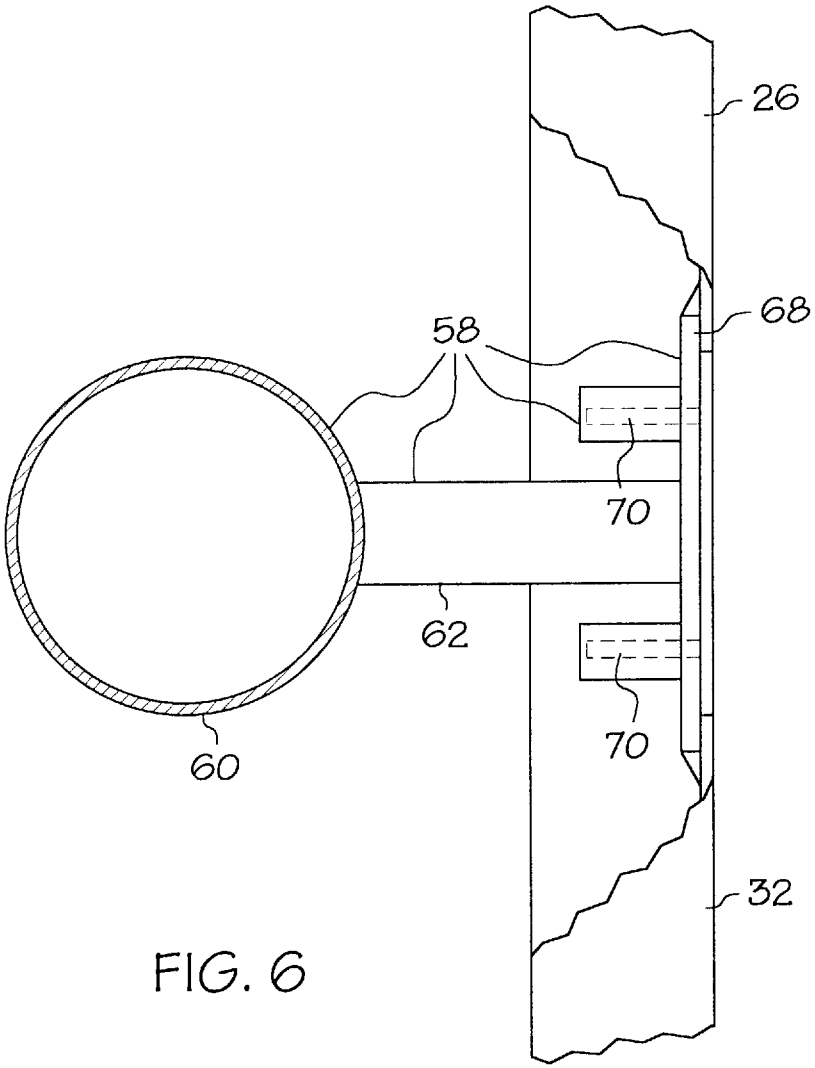
FIG. 6 is a cut-away planar view of a door fastener housing attached to a metal frame, taken along line 6—6 of FIG. 2.
Figure 7:
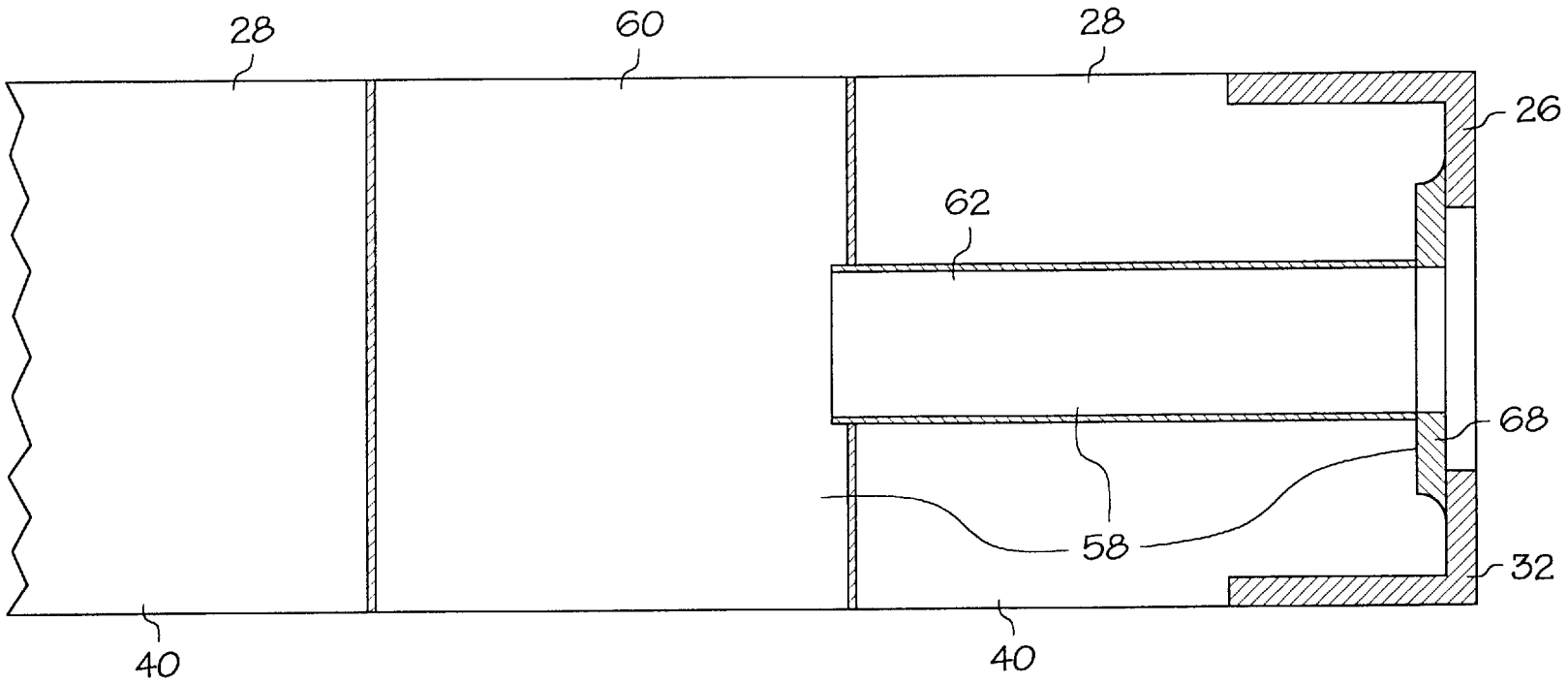
FIG. 7 is a cross-sectional view of an edge of a light-weight concrete door depicting a door fastener housing taken along line 7—7 of FIG. 2.

FIG. 6 is a cut-away planar view of a door fastener housing 58 attached to metal frame 26, taken along line 6—6 of FIG. 2, and FIG. 7 is a cross-sectional view of an edge of door 20 depicting door fastener housing 58 taken along line 7—7 of FIG. 2. The following discussion refers to FIGS. 2, 6, and 7.

Door fastener housing 58 is made of a hollow metal cylinder 60 as long as door 20 is thick to which is attached one end of a rectangular metal tube 62, the other end of tube 62 being attached to metal frame 26. Metal cylinder 60 and tube 62 are embedded into door 20 during casting. Metal cylinder 60 provides an opening in body 28 into which a conventional door handle assembly 64 or lock assembly 66 (see FIG. 1) may be mounted. The use of metal cylinder 60 eliminates the need to drill or core door 20. Similarly, metal tube 62 provides an opening into which a latch assembly or deadbolt assembly (not shown) may be mounted. Since a conventional latch or deadbolt assembly has a T-shaped form, with the tee being a rectangular mounting plate, a rectangular opening of a suitable size to receive the rectangular mounting plate is made in the central outer edge of U-channel 32. This hole is backed by a metal backing plate 68 and provides the required mounting recess for the latch or deadbolt assembly. In this embodiment, metal backing plate 68 has two threaded mounting bosses 70 into which the screws attaching the latch or deadbolt may be screwed.

Those skilled in the art will appreciate that door 20 may be fabricated with the appropriate number of door fastener housings 58. For example, there may be one housing 58 for doors 20 with either latches only or deadbolts only, two housings 58 for doors 20 with latches and deadbolts, or no housings for doors 20 with external hardware or doors 20 that are the "fixed" half of double doors.

Similarly, those skilled in the art will appreciate that holes may be drilled in U-channel 32 and threaded bosses 70 and other devices installed in any required surface of U-channel 32 at any required location to facilitate the mounting of desired external hardware, e.g., push bars, closers, etc.

Figure 8:
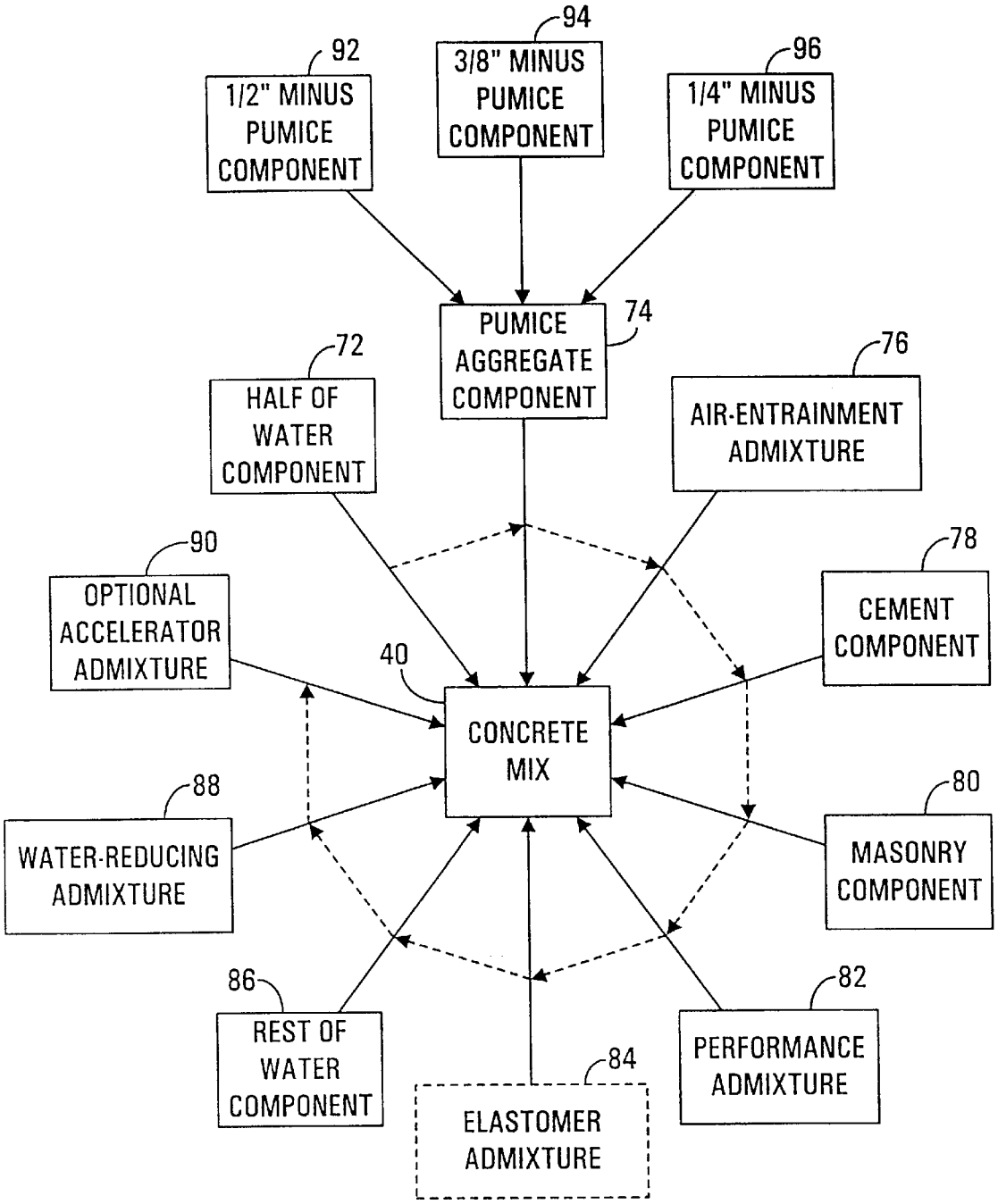
FIG. 8 is a block diagram depicting the composition of a concrete mix and a method of making the concrete mix according to a preferred embodiment of the present invention.

FIG. 8 is a block diagram depicting the composition of concrete mix 40 and a method of making concrete mix 40 according to a preferred embodiment of the present invention. Concrete mix 40 is a mixture of several distinct components, in specific quantities mixed in a specific order, set forth below in table 1.

TABLE 1

| |
|---|
| 1. A first water component 72 |
| 2. A pumice aggregate component 74 |
| 3. An air-entrainment admixture 76 |
| 4. A cement component 78 |
| 5. A masonry component 80 |
| 6. A performance admixture 82 |
| 7. A conditional elastomer admixture 84 |
| 8. A second water component 86 |
| 9. A water reducing admixture 88 |
| 10. An optional accelerator admixture 90 |

The creation of concrete mix 40 is accomplished by combining the components listed in table 1 in a suitable receptacle, e.g., a cement mixer, wheelbarrow, tub, etc., to form a slurry. Each of the components has, in the preferred embodiment, a specific description and quantity. While the following discussion presumes the preferred embodiment and uses those specific descriptions and quantities, those skilled in the art will readily recognize that alternate equivalent components may be used, and that quantities of each component may be individually varied, typically by ±20 per cent, and still produce concrete mix 40 in a viable form.

Water components 72 and 86 together make up 54 pounds of water (6½ gallons). First water component 72 is one-half of the total water, or 27 pounds (3¼ gallons), and is placed into the receptacle as the first component of concrete mix 40.

Pumice aggregate component 74 is then added to water component 72 and mixed to form the slurry. Pumice aggregate component 74 is itself made up of three different commercial pumices: a first pumice component 92 of a first grade (47 pounds of ½" minus pumice), a second pumice component 94 of a second grade (35 pounds of ⅜" minus pumice), and a third pumice component 96 of a third grade (35 pounds of ¼" minus pumice).

Again, while the preferred embodiment calls for 112 pounds of pumice aggregate component 74 made up of three grades, it is entirely feasible to use an aggregate of a different composition. For proper dispersal throughout concrete mix 40, pumice aggregate component 74 should have at least two grades. The first or larger grade should be of a size small enough to pass easily through metal mesh 56 during casting, and should be approximately twice the size of the second or smaller grade. Each of the two grades of pumice should make up significantly more than 20 per cent of pumice aggregate component 74.

Air-entrainment admixture 76, such as 24 milliliters of Darex-AEA® from Grace Concrete Products of Cambridge, Mass., is then added to and mixed into the slurry. Admixture 76, by homogeneously entraining air within concrete mix 40, allows door 20 to be lighter without significantly reducing its strength.

Next, added to and mixed with the slurry is 83 pounds of cement compound 78. Conventional commercial portland cement, well known in the art, is used.

The next component to be added to and mixed into the slurry is masonry component 80. Masonry component 80 is usually 98 pounds of crushed-masonry sand, however 98 pounds of silica sand may be substituted and still adhere to the requirements of the preferred embodiment.

Performance admixture 82, such as 8 pounds of Force 10,000™ from Grace Concrete Products, is then added to and mixed into the slurry. The addition of performance admixture 82 significantly increases the compressive and flexural strength of door 20.

Conditionally, strengthening material 54 in the form of elastomer admixture 84 is added to and mixed into the slurry. Elastomer admixture 84 is approximately 12½ ounces of CRE® from Concrete Technologies of Ames, Iowa, and contains long-chain polymer fibers that bind concrete mix 40 to itself.

Metal mesh 56 and elastomer admixture 84 serve the same function. They each prevent body 28 of door 20 from crumbling when cracking occurs during a fire. Therefore, if metal mesh 56 is used as strengthening material 54, then elastomer admixture 84 is not used. Conversely, if metal mesh 56 is not used, then strengthening material 54 is elastomer admixture 84.

The next component added to and mixed into the slurry is second water component 86, which is the remaining 27 pounds (3¼ gallons) of the water. However, second water component 86 is not added all at once, and not necessarily all of the water is added. Rather, only enough water is mixed into the slurry to form a 1" slump. This 1" slump indicates that concrete mix 40 will have the proper pouring consistency at completion of the mixing process.

The normally-last component of concrete mix 40 added to and mixed into the slurry is water-reducing admixture 88, such as 8 ounces of Daracem®-50 from Grace Concrete Products. Water-reducing admixture 88 provides improved setting times and finish characteristics, hence improving both the curing and the appearance of body 28.

Wherever conditions of temperature and/or humidity are such as to inhibit normal curing of body 28, up to 14 ounces of a commercial accelerator admixture 90 may be added to and mixed into the slurry as required.

At this point, the slurry is now concrete mix 40, and is ready for pouring into mold 38. Once poured, vibrated to eliminate voids, smoothed, and cured using conventional concrete-working procedures, door 20 is extracted from mold 38 and is complete except for cosmetic finishing, where desired.

In summary, the present invention is a door 20 in which a concrete body 28 composed of a specific concrete mix 40 is cast in place inside a metal frame 26 of a specific design. The use of concrete mix 40 and metal frame 26 provide door 20 with the structural integrity to pass stringent ASTM testing for a three-hour fire door.

While the preferred embodiment described above utilizes specific quantities of specific products, it will be readily apparent to those skilled in the art that various modifications may be made therein without departing from the spirit of the invention or from the scope of the appended claims.

What is claimed is:

1. A fire door having a width, a height, and a thickness, said door comprising:

a metal frame defining said width and said height, wherein said frame is less than two inches in thickness;

a body cast in place within said metal frame, said body comprising a concrete mix and a material to inhibit crumbling of said body in the presence of a fire; and a hinge coupled to said metal frame.

2. A door as claimed in claim 1 wherein said metal frame comprises:

a U-channel affixed to said door with an open side of said U-channel pointing inwards; and a plurality of devices for bonding said U-channel to said concrete mix.

3. A door as claimed in claim 2 wherein each of said bonding devices comprises an irregularly shaped member bonded to said concrete mix by having said concrete mix conformably cast around said irregularly shaped member and attached to said metal frame.

4. A door as claimed in claim 3 wherein said irregularly shaped member comprises:

a first part extending in a first direction;

a second part extending in a second direction;

said first direction is approximately perpendicular to an edge of said door closest to said irregularly shaped member; and said second direction is approximately perpendicular to said first direction.

5. A door as claimed in claim 1 wherein said metal frame additionally comprises at least one housing embedded into said door for installation of a door fastener into said door.

6. A door as claimed in claim 5 wherein said housing comprises:

a hollow cylinder through said door; and a rectangular tube extending from said hollow cylinder to said metal frame.

7. A door as claimed in claim 1 wherein said concrete mix comprises:

a water component;

a pumice aggregate component;

an air-entrainment admixture;

a cement component;

a masonry component;

a performance admixture; and a water-reducing admixture.

8. A door as claimed in claim 1 wherein:

said concrete mix comprises an aggregate component of a predetermined maximum size;

said crumble-inhibiting material comprises a metal mesh of a size sufficient to pass said aggregate component during casting of said concrete mix; and said metal mesh is made of a wire of a size between 18 and 14 gauge.

9. A door as claimed in claim 8 wherein said metal mesh is a ¾–1¼ inch metal mesh.

10. A door as claimed in claim 1 wherein said crumble-inhibiting material comprises a non-metallic fibrous material.

11. A door as claimed in claim 10 wherein said non-metallic fibrous material comprises an elastomer admixture.

12. A door as claimed in claim 1 wherein said hinge:

is a piano hinge;

is substantially equal in length to said door; and is attached to a hinge edge of said door throughout its length.

13. A door as claimed in claim 1 wherein said door has a thickness of less than two inches.

14. A door as claimed in claim 1 wherein said concrete mix, prior to casting, is a slurry having a gross weight, wherein said slurry comprises:

a water component as about 12.2 to 18.2 percent of said gross weight;

an aggregate component as about 25.2 to 37.8 percent of said gross weight;

an air-entrainment admixture as about 5.4 to 8.1 milliliters per hundred pounds of said gross weight;

a cement component as about 18.7 to 28.0 percent of said gross weight;

a masonry component as about 22.1 to 33.1 percent of said gross weight;

a performance admixture as about 1.8 to 2.7 percent of said gross weight; and a water-reducing admixture as about 1.8 to 2.7 ounces per 100 pounds of said gross weight.

15. A door as claimed in claim 14 wherein:

said crumble-inhibiting material is a metal mesh of a predetermined size;

said aggregate component is a pumice aggregate component comprising at least a first and a second grade thereof;

said first grade of said aggregate comprises at least 20 percent of the whole of said aggregate and is of a size so as to pass freely through said metal mesh during casting; and said second grade of said aggregate comprises at least 20 percent of the whole of said aggregate and is of a size approximately one-half the size of said first grade of said aggregate.

16. A door as claimed in claim 15 wherein:

said metal mesh is a ¾–1¼ inch metal mesh;

said pumice aggregate component comprises a first, a second, and a third grade thereof;

said first grade of said aggregate comprises ½ inch minus pumice as about 10.6 to 15.9 percent of said gross weight of said slurry;

said second grade of said aggregate comprises ⅜ inch minus pumice as about 7.9 to 11.8 percent of said gross weight of said slurry; and said third grade of said aggregate comprises ¼ inch minus pumice as about 7.9 to 11.8 percent of said gross weight of said slurry.

17. A door as claimed in claim 14 wherein:

said crumble-inhibiting material comprises an elastomer admixture; and said slurry additionally comprises said elastomer admixture as about 2.8 to 4.2 ounces per hundred pounds of said gross weight.

18. A door as claimed in claim 14 wherein said slurry additionally comprises an accelerator admixture as about 3.2 to 4.7 ounces per hundred pounds of said gross weight.

19. A door as claimed in claim 14 wherein said slurry comprises:

said water component as approximately 15.2 percent of said gross weight;

said pumice aggregate component as approximately 31.5 percent of said gross weight;

said air-entrainment admixture as approximately 6.75 milliliters per hundred pounds of said gross weight;

said cement component as approximately 23.4 percent of said gross weight;

said masonry component as approximately 27.6 percent of said gross weight;

said performance admixture as approximately 2.3 percent of said gross weight; and said water-reducing admixture as approximately 2.25 ounces per 100 pounds of said gross weight.

20. A door as claimed in claim 19 wherein:

said crumble-inhibiting material comprises an elastomer admixture; and said slurry additionally comprises said elastomer admixture as approximately 3.5 ounces per hundred pounds of said gross weight.

* * * * *